US010532601B2

(12) United States Patent
Davies-Smith

(10) Patent No.: US 10,532,601 B2
(45) Date of Patent: Jan. 14, 2020

(54) WRITING INSTRUMENT WITH MAGNETIC FEATURES AND QUICK REFILL CAPABILITY

(71) Applicant: Scribe Technical Consulting LLC, Lebanon, NJ (US)

(72) Inventor: Leighton Davies-Smith, Lebanon, NJ (US)

(73) Assignee: SCRIBE TECHNICAL CONSULTING LLC, Lebanon, NJ (US)

( * ) Notice: Subject to any disclaimer, the term of this patent is extended or adjusted under 35 U.S.C. 154(b) by 0 days.

(21) Appl. No.: 16/068,652

(22) PCT Filed: Jan. 8, 2017

(86) PCT No.: PCT/US2017/012657
§ 371 (c)(1),
(2) Date: Jul. 6, 2018

(87) PCT Pub. No.: WO2017/120565
PCT Pub. Date: Jul. 13, 2017

(65) Prior Publication Data

US 2019/0023057 A1 Jan. 24, 2019

Related U.S. Application Data

(60) Provisional application No. 62/276,467, filed on Jan. 8, 2016.

(51) Int. Cl.
*B43K 24/02* (2006.01)
*B43K 23/00* (2006.01)
(Continued)

(52) U.S. Cl.
CPC ..... *B43K 24/02* (2013.01); *B43K 1/08* (2013.01); *B43K 5/00* (2013.01); *B43K 7/005* (2013.01);
(Continued)

(58) Field of Classification Search
CPC ..... B43K 24/02; B43K 29/00; B43K 29/12; B43K 7/12; B43K 7/005; B43K 5/00;
(Continued)

(56) References Cited

U.S. PATENT DOCUMENTS 1,521,481 A 12/1924 Spencer
1,757,884 A 5/1930 Tuggle
(Continued)

FOREIGN PATENT DOCUMENTS

CA 69223 11/1900
CA 2499834 A1 9/2006
(Continued)

OTHER PUBLICATIONS

Badge Holder with Pen Holder, https://www.imprintcenter.com/badge-holder-with-pen-holder.html; Sep. 26, 2015; 2 pages.
(Continued)

*Primary Examiner* — Paul R Durand
*Assistant Examiner* — Randall A Gruby
(74) *Attorney, Agent, or Firm* — Lempia Summerfield Katz LLC

(57) ABSTRACT

A writing instrument assembly has a writing instrument with a body and a working tip extended or extendable from the body. A holder has a landing spot for the writing instrument. The writing instrument is magnetically and detachably retained at the landing spot when attached to the holder. The working tip is sheathed or covered automatically when the
(Continued)

writing instrument is attached to the holder and is unsheathed or uncovered when detached from the holder.

14 Claims, 12 Drawing Sheets

(51) Int. Cl.

| | |
|---|---|
| ***B43K 23/02*** | (2006.01) |
| ***B43K 29/12*** | (2006.01) |
| ***B43K 1/08*** | (2006.01) |
| ***B43K 5/00*** | (2006.01) |
| ***B43K 7/00*** | (2006.01) |
| ***B43K 7/12*** | (2006.01) |
| ***B43K 25/00*** | (2006.01) |
| ***B43K 29/00*** | (2006.01) |

(52) U.S. Cl.
CPC ..... *B43K 7/12* (2013.01); *B43K 23/002* (2013.01); *B43K 23/02* (2013.01); *B43K 25/00* (2013.01); *B43K 29/00* (2013.01); *B43K 29/12* (2013.01)

(58) Field of Classification Search
CPC ..... B43K 1/08; B43K 25/00; B43K 23/02; B43K 23/002
See application file for complete search history.

(56) References Cited

U.S. PATENT DOCUMENTS

| | | | | | |
|---|---|---|---|---|---|
| D119,263 | S | | 3/1940 | Harris | |
| D126,555 | S | | 4/1941 | Gurtov | |
| 2,338,068 | A | | 12/1943 | Harris | |
| 2,386,500 | A | | 10/1945 | Parker | |
| 2,644,212 | A | | 7/1953 | Markowitz | |
| 2,725,038 | A | * | 11/1955 | Morris | B43K 24/08 401/100 |
| 2,866,993 | A | * | 1/1959 | Edelstone | A45D 34/043 401/100 |
| 2,870,741 | A | * | 1/1959 | Kersten | B43K 24/03 401/100 |
| 2,941,511 | A | * | 6/1960 | Cieremans | B43K 7/005 401/116 |
| 3,063,419 | A | * | 11/1962 | Parker | B43K 24/02 401/100 |
| 4,176,979 | A | * | 12/1979 | Saida | B43K 24/03 401/100 |
| D268,501 | S | | 4/1983 | Kruckel et al. | |
| 4,482,063 | A | | 11/1984 | Berke et al. | |
| 4,496,058 | A | | 1/1985 | Harris et al. | |
| 4,601,599 | A | * | 7/1986 | Katoh | B43K 7/005 401/100 |
| D299,475 | S | | 1/1989 | Munnik | |
| D313,042 | S | | 12/1990 | Lecce | |
| D342,088 | S | | 12/1993 | Sonntag et al. | |
| D344,760 | S | | 3/1994 | Monzyk | |
| 5,449,242 | A | | 9/1995 | Salamone | |
| 5,480,037 | A | | 1/1996 | Pope | |
| 5,522,146 | A | | 6/1996 | Warburton | |
| D389,519 | S | | 1/1998 | Duford | |
| 5,820,095 | A | | 10/1998 | Stone | |
| D422,309 | S | | 4/2000 | Bond | |
| 6,276,854 | B1 | | 8/2001 | Mullins | |
| 6,474,889 | B2 | * | 11/2002 | Kato | B43K 24/02 401/107 |
| D501,877 | S | | 2/2005 | Granick | |
| 6,948,251 | B2 | | 9/2005 | Jebe et al. | |
| D524,372 | S | | 7/2006 | Granick | |
| D524,863 | S | | 7/2006 | Granick | |
| D579,045 | S | | 10/2008 | Allemand | |
| D579,046 | S | | 10/2008 | Allemand | |
| D601,625 | S | | 10/2009 | Yeh | |
| 7,645,083 | B2 | | 1/2010 | Burry et al. | |
| D625,580 | S | | 10/2010 | Giordano | |
| D698,863 | S | | 2/2014 | Ryan et al. | |
| D713,459 | S | | 9/2014 | Zeitler | |
| 8,864,397 | B2 | | 10/2014 | Ryan | |
| D724,665 | S | | 3/2015 | Woolard | |
| D733,325 | S | | 6/2015 | Robinson, Jr. | |
| D762,456 | S | | 8/2016 | Lo et al. | |
| D764,895 | S | | 8/2016 | White | |
| D788,328 | S | | 5/2017 | Mittag | |
| 9,744,796 | B1 | * | 8/2017 | Lyon | B43K 7/005 |
| D810,823 | S | | 2/2018 | Kermoal et al. | |
| 2004/0228671 | A1 | | 11/2004 | Sunatori | |
| 2007/0243007 | A1 | | 10/2007 | Chang | |
| 2009/0035050 | A1 | | 2/2009 | Ramos | |
| 2009/0175672 | A1 | * | 7/2009 | Killion | B43K 23/001 401/100 |

FOREIGN PATENT DOCUMENTS

| | | |
|---|---|---|
| DE | 848166 | 9/1952 |
| WO | 2004030932 | 4/2004 |
| WO | 2012118385 A1 | 9/2012 |

OTHER PUBLICATIONS

CopperPen®, produced by Solioz Scientific of Switzerland; http://copperpen.ch/; retrieved from the internet Jul. 18, 2018; 1 page.
Cross Century Copper Ballpoint Pen, https://www.amazon.com/Cross-Ballpoint-Antimicrobial-Appointments-AT0082S-65/dp/B00F1Q0JMW; Aug. 1, 2015; 2 pages.
Search Report dated Jun. 7, 2017, International Search Report in corresponding PCT Application No. PCT/US17/12657; dated Jun. 7, 2017; 3 pages.
Supplementary Partial European Search Report cited in the corresponding European Application No. 17736497.3; dated Sep. 23, 2019; 13 pp.

* cited by examiner 42
36
24
46
44
52
48
58
30
38
60
26
74
22
70
40
56
54
72
20

WRITING INSTRUMENT WITH MAGNETIC FEATURES AND QUICK REFILL CAPABILITY

RELATED APPLICATION DATA

This application is a U.S. national stage of prior filed international application no. PCT/US2017/012657, filed Jan. 8, 2017, and which claims priority to U.S. provisional application Ser. No. 62/276,467 filed on Jan. 8, 2016 and entitled "Writing Instrument with Magnetic Features and Quick Refill Capability." The entire contents of these prior filed applications are hereby incorporated herein by reference.

BACKGROUND

1. Field of the Disclosure

The present disclosure generally relates to writing instruments, and more particularly to a writing instrument with copper components, a magnetic holder, magnetic sheathing of the writing tip, and/or an easy refill apparatus, system, and method.

2. Description of Related Art

The U.S. Environmental Protection Agency (EPA) has recently registered copper and its alloys as the only solid antimicrobial materials. Copper is generally effective at killing 99.9% of certain microbes (bacteria and viruses) significantly faster than the ability of stainless steel to kill the same bugs. This antimicrobial characteristic has prompted many hospitals and other healthcare type facilities to switch from stainless steel to copper or brass contact surfaces for common touch-points throughout their facilities. Such contact or touch points may include door handles, push plates, toilet seats, flush handles, bed railings, stair hand-rails, surgical scalpels, and the like.

Writing instruments, and typically pens, are used regularly and daily in hospital and health care environments. Thus, the writing instruments or pens themselves define additional touch points or contact surfaces. As a tool used extensively by nurses, doctors, and other staff in these types of environments, the pen is yet another potential source of bacterial and viral transmission. A pen manufactured from copper or one of its alloys can afford a significant reduction in the possibility of the pen being a vector for this type of bacterial and viral transmission. A clinical study conducted in the United Kingdom did in fact demonstrate the antimicrobial benefits of such a pen.

Copper-based pens are known in the art. However, the typical known copper based pens are expensive for frontline nurses, doctors, and other staff, as such copper pens are typically a higher end product. Such staff members would value and benefit from the antimicrobial properties of writing instruments that incorporate copper as a part of the writing instrument. However, such staff members would also be quite concerned about the risk of losing and having to replace such an expensive writing instrument. As a result, such writing instruments are not commonplace in hospitals and health care facilities. Examples of existing copper based writing instruments are the CopperPen® produced by SOLIOZ SCIENTIFIC of Switzerland (www.copperpen.ch) and the Century® Copper Pen produced by the A.T. CROSS COMPANY of the U.S. (http://www.cross.com/catalog/productdetail.aspx?id=AT0082S-65(Cross)).

The majority of pens (including the aforementioned and other known copper variety) are 'traditional' in the nature of their design. The typical pen has a clip, a push-button or twist-action mechanism to expose or retract the writing tip, and/or a separate cap to cover or expose the writing tip. These common pen features require, in many instances, two hands in order to use them. The typical pen requires two hands for the removal of a cap, two hands to clip the pen to a pocket or other surface element, two hands to actuate the mechanism to expose the tip for writing, and/or two hands to retract or cover the tip when not writing.

In addition, the typical holder mechanism is a pen clip for these types of writing instruments. A pen clip cannot be fabricated from copper or a copper alloy and still deliver the requisite mechanical functions of a durable clip. Such copper or copper alloy materials are either too soft, too hard, or lack the necessary resiliency or spring action. A copper based clip would thus be unable to meet the normal performance requirements typically expected of a pen clip.

A push-button actuating mechanism, while allowing one-handed actuation, necessitates a separate operation to expose the writing tip before writing. Furthermore, much of the mechanism is internalized within the pen body, potentially allowing microbial growth to proceed unhindered and out of view. This type of mechanism is designed to retract the tip to both protect the tip from damage and protect the surrounding surfaces from unwanted and accidental ink contamination. No doubt this type of pen interface is repeated dozens of times a day by busy nurses. It may also be that a staff member fails to remember or chooses not to retract the writing tip at times when not using the pen. This can result in contamination of and/or damage to the writing tip and thus potentially the internal components and/or normal function of the pen over time.

On most pens, replacement of the ink refill can also be a rather cumbersome procedure. In many instances, parts of the pen, including the barrel, must be disassembled in order to access, remove, and replace the ink refill. Doing so in a clean environment such as a hospital may then also contaminate surfaces within the hospital and/or parts of the writing instrument while the writing instrument is disassembled.

SUMMARY

In one example, according to the teachings of the present disclosure, a writing instrument assembly includes a writing instrument having a body and a working tip extended from the body and includes a holder providing a landing spot for the writing instrument. The writing instrument is magnetically and detachably retained at the landing spot when attached to the holder. The working tip is capped, sheathed, or covered automatically when the writing instrument is attached to the holder.

In one example, the working tip is exposed or uncovered automatically when the writing instrument is detached from the holder.

In one example, according to the teachings of the present disclosure, a writing instrument assembly includes a writing instrument having a body and a working tip extended from the body and includes a holder providing a landing spot for the writing instrument. The writing instrument is magnetically and detachably retained at the landing spot when attached to the holder. The working tip is exposed or uncovered automatically when the writing instrument is detached from the holder.

In one example, the disclosed holders can include one or more magnets.

In one example, the disclosed writing instruments can include one or more magnetically attractive elements positioned to engage or interact with one or more magnets of a holder.

In one example, the magnetically attractive elements can be steel bodies within the body of the writing instrument.

In one example, the steel bodies can be ring or cylinder shaped.

In one example, the holders disclosed herein can include a steel backing plate rendering the holder magnetically attachable to another surface or object.

In one example, the disclosed writing instruments can include one or more magnets.

In one example, the disclosed holders can include one or more magnetically attractive elements positioned to magnetically engage or interact with one or more magnets on a writing instrument.

In one example, the disclosed holders can be an ID badge or a part of an ID badge.

In one example, the disclosed holders can be an integrated or integral part of another object.

In one example, the disclosed holders can be attached to or attachable to another object.

In one example, the body of the disclosed writing instruments can be formed of a copper or a copper-based alloy.

In one example, according to the teachings of the present disclosure, a writing instrument assembly includes a writing instrument having a body and a working tip extendable from the body and includes a mechanism at least partly provided within the body. The mechanism is magnetically actuable to automatically extend the working tip from and retract the working tip into the body and/or to automatically extend a tip cover of the mechanism to cover and to automatically retract the tip cover from covering the working tip, depending on the position of the mechanism relative to one or more magnets. The mechanism does not include any other latching or locking device to retain the working tip and/or the tip cover in a given position, other than the one or more magnets. A portion of the mechanism is provided on a holder for the writing instrument.

In one example, the one or more magnets can be provided on the holder or on the writing instrument. One or more attractive elements can be provided on the other of the holder or the writing instruments. The one or more attractive elements can be positioned to magnetically engage or interact with the one or more magnets when the writing instrument is attached to the holder.

In one example, the mechanism can include a shroud slidable within the body. The shroud can carry the tip cover and can be magnetically slidable between a position whereby the tip cover is covering the working tip and a position whereby the tip cover exposes the working tip.

In one example, the working tip can always protrude from the body and a shroud or sheath can move relative to the working tip to cover and uncover the working tip.

In one example, the body can be formed of copper or a copper-based alloy.

In one example, a shroud within the body can be formed of copper or a copper based alloy.

In one example, both a shroud within the body and the body itself can both be formed of copper or a copper alloy. In one example, the two components can be formed of different such materials.

In one example, the writing instrument can be magnetically and detachably retained at a landing spot to the holder. When retained on the holder, the working tip can be sheathed or covered automatically.

In one example, according to the teachings of the present disclosure, a writing instrument includes a hollow body and a refill assembly held within the body. The refill assembly has a refill holder and a refill tube retained by the refill holder. The writing instrument also includes an actuator protruding from one end of the body and coupled to the refill holder. The actuator is actuable to extend the refill tube from an opening in another end of the body such that the refill tube is removable from the refill holder and the body through the opening. A replacement refill tube is insertable into the opening and attached to the refill holder.

In one example, the disclosed refill tubes can be frictionally retained in or attached to a refill holder.

In one example, the actuator can be a rotatable button.

In one example, portions of the refill assembly can be threaded.

In one example, portions of the mechanism can be correspondingly threaded.

In one example, according to the teachings of the present disclosure, a writing instrument assembly includes a writing instrument having a working tip and includes a holder. A magnetic mechanism detachably retains the writing instrument to the holder. A first portion of the magnetic mechanism is carried or provided by the holder and a second portion of the magnetic mechanism is carried on or in the writing instrument. The working tip is automatically not exposed when the writing instrument is attached to the holder and is automatically exposed when the writing instrument is detached from the holder.

In other examples, according to the teachings of the present disclosure, a writing instrument assembly according to any of the examples and embodiments disclosed and described herein can include any one or more of the features, components, and characteristics disclosed and described herein in any combination thereof.

In still other examples, according to the teachings of the present disclosure, methods are disclosed for refilling a writing instrument, of automatically exposing a working tip of a writing instrument for use, of automatically covering, sheathing, or capping a working tip of a writing instrument when attached to a holder, and of automatically attaching a writing instrument to a holder according to the methods and writing instruments and assemblies.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

Figures 1, 2:
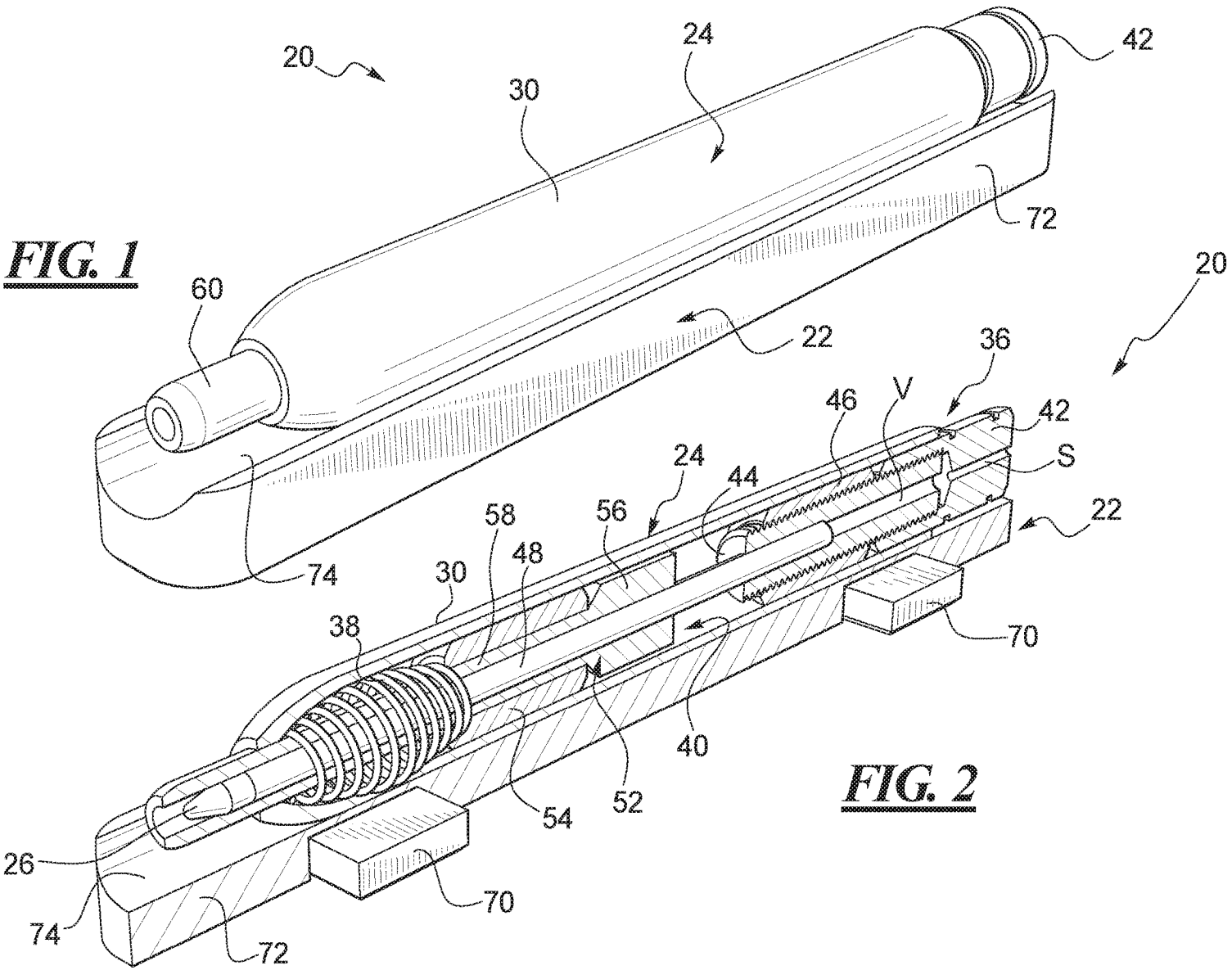
FIG. 1 shows a perspective view of one example of a writing instrument assembly, including a writing instrument and a holder, and constructed in accordance with the teachings of the present disclosure.
FIG. 2 shows a perspective lengthwise and partial cross-section taken generally along line 2-2 of the writing instrument assembly of FIG. 1.

The disclosed writing instrument solves or improves upon one or more of the above-noted and/or other problems and disadvantages with prior known pens and writing instruments. The disclosed writing instrument may employ copper or copper based alloy components. The instrument thus may be constructed to have exceptional antimicrobial properties. The disclosed writing instrument also has a magnetic actuating mechanism and holder design that: 1) allows for nearly effortless magnetic attachment of the pen to a holding surface; 2) nearly effortless detachment of the pen from the holding surface; 3) automatic exposure of the writing tip upon detachment of the pen from the holding surface; and 4) automatic covering of the writing tip upon attachment of the pen to the holding surface. The disclosed writing instrument also thus provides an automatic open/close feature for the writing tip.

The disclosed writing instrument also provides for a relatively easy procedure for replacing the ink refill from within the pen barrel without having to disassemble any part of the instrument. The simplified design of the disclosed writing instrument allows for production of a copper based writing instrument having a significantly lower price-point, which may be much more palatable for nurses and other personnel and staff. The disclosed writing instrument allows for the convenient quick-and-ready access to writing with one hand, as is often the need in many writing situations, and particularly within the hospital or health care environment. These and other objects, features, and advantages of the present invention will become apparent to those of ordinary skill in the art upon reading this disclosure.

Turning now to the drawings, FIGS. 1-4 show one example of a writing instrument assembly 20 in accordance with the teachings of the present disclosure. The writing instrument assembly 20 has a holder 22, i.e., a holding surface, carrier, mount, mounting surface, or the like (hereinafter "the holder" or "a holder" for ease of description only). As will become evident below upon reading this disclosure, the holder 22 can be an integrated or integral part of another object, can be a separate piece attached to another object, or can be a stand-alone element and can also vary in configuration and construction. The writing instrument assembly 20 also has a writing instrument 24, i.e., an ink pen, a pencil, a stylus, or the like (hereinafter "the pen" or "a pen" for ease of description only) that is attachable to and detachable from the holder 22. As will also become evident below upon reading this disclosure, the writing instrument 24 can be any number of instruments used to write, point, scribe, or the like and can also vary in configuration and construction. The instrument may have a writing tip or a working tip, which may or may not be capable of writing. The examples disclosed and described herein are merely provided to illustrate the various aspects and features of the disclosure, not to limit the scope of the disclosure to only the specific examples.

Figures 3, 4:
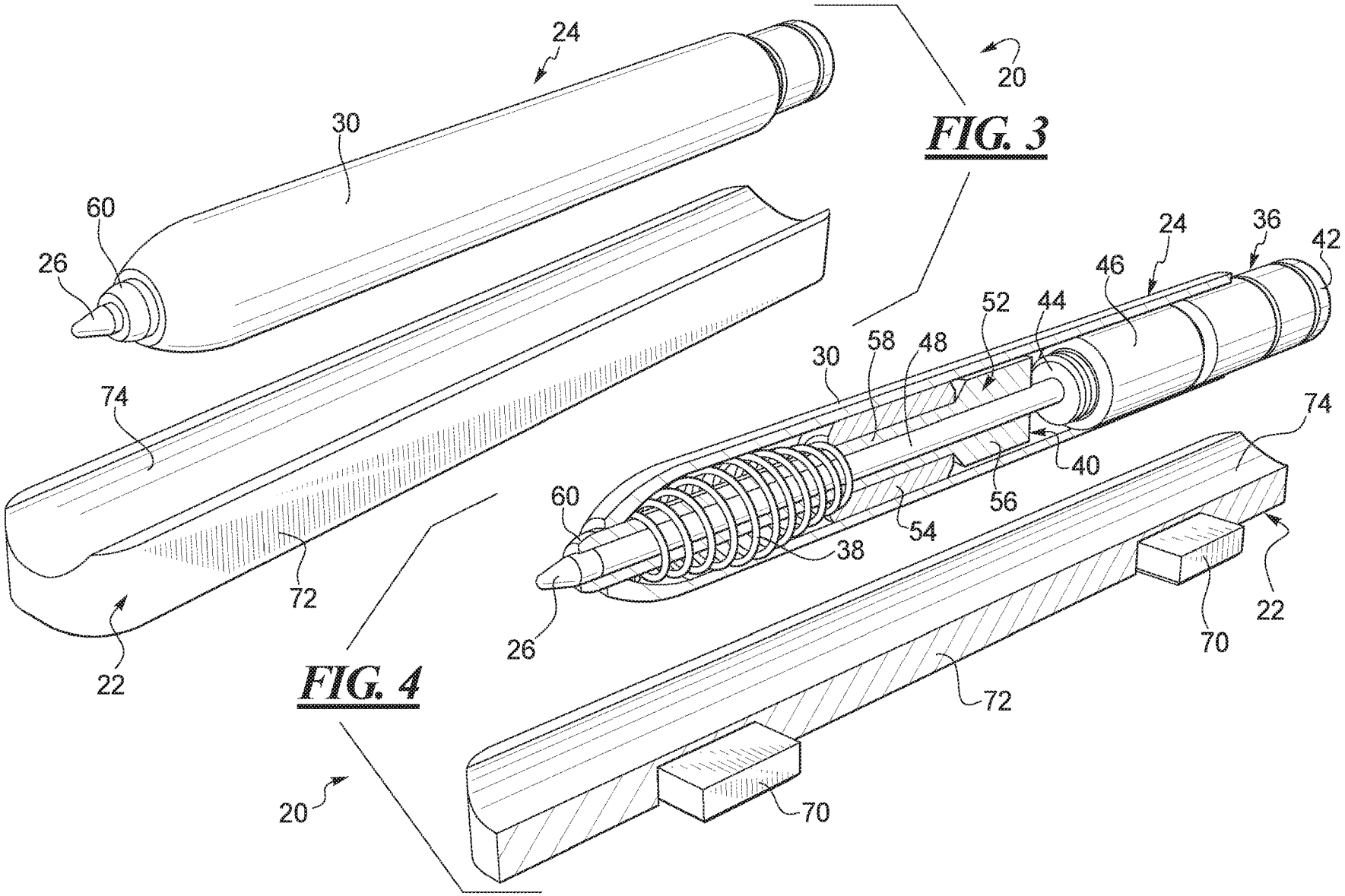
FIG. 3 shows the writing instrument assembly of FIG. 1 but with the writing instrument detached from the holder.
FIG. 4 shows the cross-section of the writing instrument assembly of FIG. 2 but with the writing instrument detached from the holder as in FIG. 3.

In one example, the writing instrument or pen 24 can be an ink pen with a writing tip 26. As generally shown in FIGS. 1 and 2, the writing tip 26 is covered, i.e., not exposed when in a closed position. As generally shown in FIGS. 3 and 4, the writing tip 26 is not covered, i.e., exposed when in an open position. As described below, the pen 24 is attached to the holder 22 via magnetic attraction, as depicted in FIGS. 1 and 2. When attached to the holder 22, the pen 24 is automatically arranged in the closed position so that the writing tip 26 is covered. The pen 24 can be nearly effortlessly detached from the holder 22 simply by overcoming the attractive magnetic force or forces holding the pen to the holder. As depicted in FIGS. 3 and 4, when the pen 24 is detached from the holder 22, the pen is automatically arranged in the open position so that the writing tip 26 is automatically uncovered.

Figure 5:
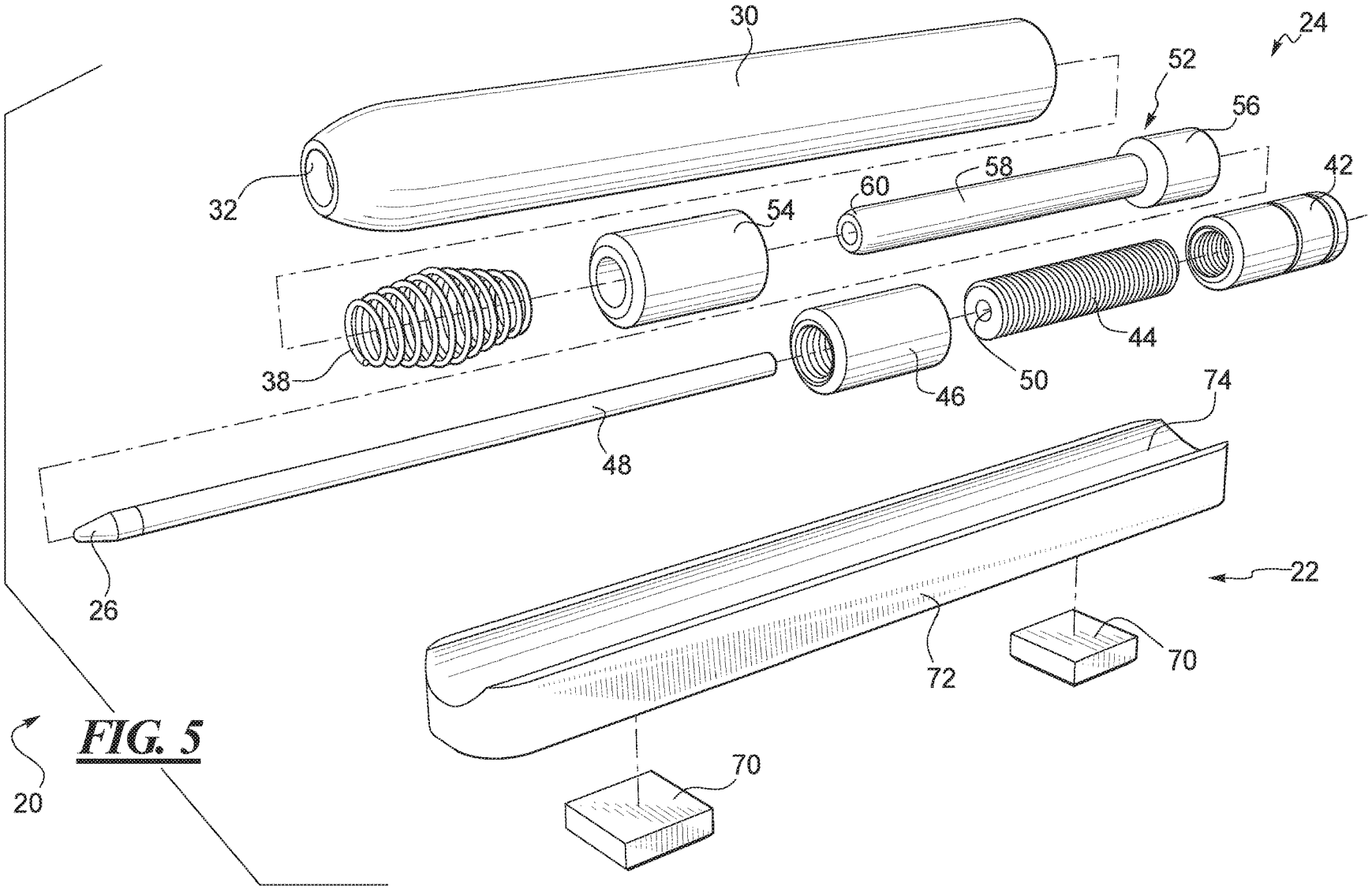
FIG. 5 shows an exploded perspective view of the writing instrument assembly of FIG. 1.

FIG. 5 shows an exploded view of the pen 24 depicted in FIGS. 1 and 3 and FIGS. 2 and 4 show assembled cross-section views of the pen. In this example, the pen 24 has a barrel or body 30 that contains the components of the pen. The body 30 in one example can be formed of copper or a copper alloy to impart antimicrobial properties, if desired, as mentioned above. However, the body 30 can be formed of any other suitable material, such as aluminum, steel, wood, or the like, particularly if the pen is not intended for use in an environment that would require or benefit from such antimicrobial properties. In this example, the body 30 is primarily cylindrical in shape and has a proximal opening 32 at one end, i.e., a proximal or writing end of the body where the writing tip 26 resides. The body 30 also has a distal opening 34 at the opposite end, i.e., a distal end of the body. As will become evident below, the body 30 of the pen 24 need not be round or cylindrical in cross-section. Instead, the body can have other shapes in cross-section and can also change in shape from one end to the other, if desired.

From right to left in FIGS. 2 and 4, and with reference to FIG. 5, the pen 24 also has a refill assembly 36, a compression spring 38, and a sleeve assembly 40. The refill assembly 36 has an actuator such as a cap or button 42 in this example that protrudes from one end, i.e., the distal end of the body 30 when the pen 24 is assembled. The refill assembly 36 also has a refill holder or retainer 44, which can be formed of a molded plastic material, such as ABS, or another suitable material. The button 42 is connected to one end of the refill holder 44, such as by mechanical threads. In other examples, the button 42 can instead be an integral part of the refill holder 44 or can be connected to the holder in different ways.

The refill assembly 36 in this example also has, or is coupled to, a first steel insert 46. The steel insert 46 can be carried on the exterior of the refill holder 44 or can be installed in the body 30 first before installing the refill assembly 36. The first steel insert 46 in one example can be sized to press fit into the body 30 of the pen 24 to securely hold at least the steel insert, as well as the refill holder 44, in place in the body. The first steel insert 46 can also be shaped to correspond to the interior shape of the body 30. In this example, the body 30 is primarily a cylinder, as is the interior of the body. Thus, the first steel insert 46 can also be a cylinder shape. However, the first steel insert 46 can be non-cylindrical and yet be press-fit into the cylindrical interior of the body 30 or into a non-cylindrical shaped body as well.

The refill assembly 36 also has a refill tube 48 that holds ink along the interior length of the tube. A distal end of the refill tube 48 is fit into and held by friction in a bore 50 on an end of the refill holder 44. The bore 50 is on the proximal end of the refill holder 44 opposite the button 42. An ink delivery or writing element, i.e., the writing tip 26 is provided on the proximal end of the refill tube 48 and forms the writing end of the pen in this example. The writing tip 26 can be in any suitable form, such as a ball point writing tip, a lead dispenser, or the like, depending on the type of writing instrument. In this example, the bore 50 communicates with an air vent V that extends along the remainder of the refill holder 44 and through the button 42. In this way, the interior of the refill tube 48 can vent to air allowing the ink to flow to the writing tip 26. Also in this example, the diameter of the bore 50 is larger than the diameter of the vent V passage. The location of the step-down in diameter can create a stop S, which defines a precise installed position of the refill tube 44 when inserted into the bore 50 on the refill holder 44.

The sleeve assembly 40 in this example has an elongate shroud 52 and a second steel insert or steel sleeve 54 carried on and fixed to the exterior of the shroud. The steel sleeve 54 is sized to loosely fit within the body 30 of the pen 24. Thus, both the steel sleeve 54 and the shroud 52 can move lengthwise along the axial length of the body 30, as described below. In this example, the steel sleeve 54 may again be cylindrical in shape, though it may instead have a non-cylindrical shape, if desired or if needed to accommodate a different shaped body 30 and/or shroud 52.

In this example, the shroud 52 has a dual diameter construction and is also cylindrical in shape. One end, i.e., a distal end of the shroud 52 has a larger diameter cylinder shaped stop portion 56. The other end, i.e., a proximal end of the shroud 52 has an elongate smaller diameter sheath portion 58. The shroud 52 in this example has a lengthwise opening along its entire length and of the same diameter. The opening is sized and configured to receive the refill tube 48 therein and to slide relative to the refill tube and writing tip 26 of the refill assembly 36, as depicted by FIGS. 2, 4, 6, and 7. The shroud 52, or at least the sheath portion 58, can be made from copper, a copper alloy, such as brass, or other suitable material, depending on whether the shroud 52, or at least the exposed part thereof, is to provide the aforementioned antimicrobial or antibacterial properties. In this example, the stop portion 56 of the shroud 52 is solid, except for the opening for the refill tube 48. As noted below, the stop portion 56 may instead be a hollow cup shape, if desired, to save material cost or for other functional reasons, also as noted below.

The body 30 of the pen 24 is hollow along its length to receive the refill assembly 36 and sleeve assembly 40 therein, as depicted in FIGS. 2, 4, 6, and 7. The proximal end of the body 30 is tapered down to a smaller diameter and thus defines the smaller diameter proximal opening 32 in that end of the body. The proximal opening 32 is sized to permit the writing tip 26 of the refill tube 48 to extend outward from the body 30. The proximal opening 32 is also sized to permit a tip cover end 60 of the sheath portion 58 on the shroud 52 to slide outward from and inward into the body 30, as described below. The compression spring 38 is captured within the body 30 between the fixed tapered proximal end of the body and the steel sleeve 54 on the shroud 52, both of which can move in concert within the body. The spring 38 thus biases the sleeve assembly 40 to the right in FIG. 3 in the direction of the refill assembly 36 and away from the proximal opening 32. In doing so, the tip cover end 60 is also biased inward partially or completely into the body 30, exposing the writing tip 26 of the refill tube 48. Thus, the pen 24 is biased normally to an open position, i.e., a writing condition or configuration, as depicted in FIGS. 1 and 2.

Figure 8A:
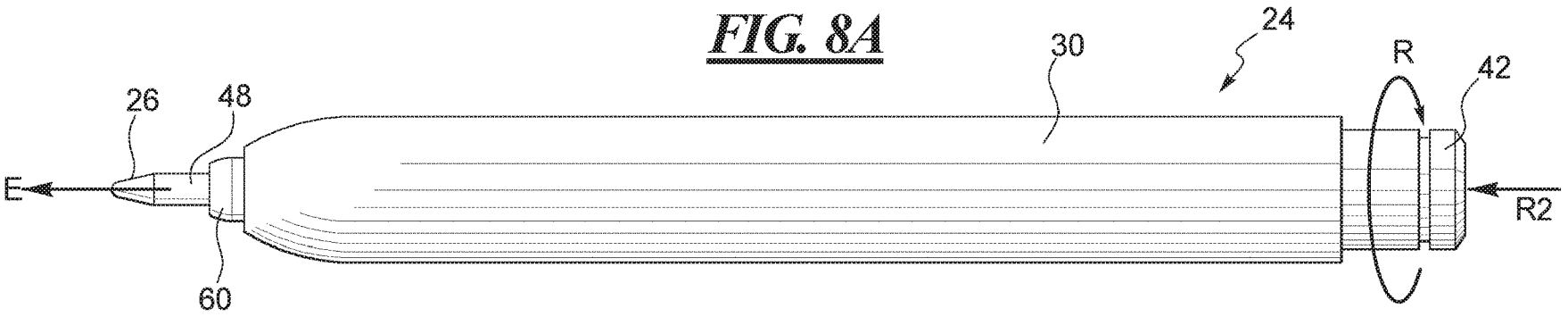
FIG. 8 shows one example of a method to remove an ink refill portion of the writing instrument depicted in FIGS. 1-7.

The refill tube 48 is simple to replace in this example. In this example, as shown in FIG. 8A, the button 42 is fixed to the distal end of the refill holder 44. The first steel insert 46 has internal female threads and the refill holder 44 has external male threads and is threaded through the steel insert. In one example, a user need only rotate the button 42 in one direction, i.e., such as in a clockwise direction as represented by the arrow R. By doing so, the refill holder 44 also rotates relative to the fixed first steel insert 46, thereby moving the button 42 and refill holder toward the proximal end of the body 30 as represented by the arrow RR. This in turn extends the refill tube 48 and writing tip 26 further from the proximal end of the body 30 as represented by the arrow E. This exposes a sufficient length of the refill tube 48 from the proximal opening 32 so that a user can grasp the refill tube. The user then can pull the refill tube 48 from the refill holder 44 and out of the body 30 by overcoming the retention friction or other retention device between the refill tube and the bore 50 in the refill holder. A new or replacement refill tube can be obtained and slipped into the proximal opening 32 in the body 30 and then pressed into the bore 50 in the refill holder 44. The user can then rotate the button 42 in the reverse or opposite direction to the arrow R to return the refill tube to the proper position for writing.

Though not shown in this example, one or more stops can be positioned and/or provided on the appropriate components (refill holder, mechanical threads, pen body, steel insert, or the like) to limit travel of the refill body in either or both directions. In this example, though not depicted in FIG. 8A, the proximal end of the button 42 and the distal end of the first steel insert 46 can be design to contact one another at a position sufficient to extend the refill tube 48 for removal but to prevent the refill holder 44 from traveling any further toward the proximal end of the body 30. Other stop devices or configurations may also be used to limit travel of the components in either direction and/or to automatically position the writing tip 26 properly for use and so that it is adequately covered or sheathed with the pen 24 in the closed position, as described below.

Figure 8B:
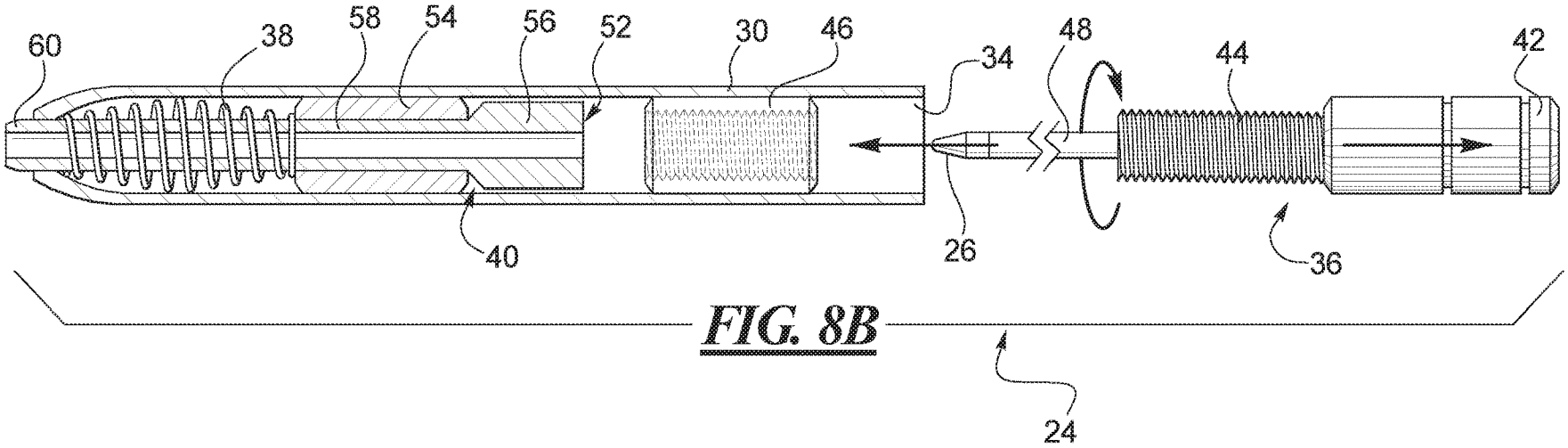

In one alternate example, as shown in FIG. 8B, the refill tube 48 can be replaced in a different way. In this example, the entire refill assembly 36 may be removed from the body 30. More specifically, the button 42 is still fixed to the distal end of the refill holder 44. A user can rotate the refill holder 44 in the direction of the arrow R to completely withdrawn the refill holder, the button 42, and the refill tube 48 from the mechanical threads of the first steel insert 46 and from the distal opening 34 of the body 30, removing these components from the pen 22. The user can then remove the refill tube 48 from the bore 50 in the refill holder 44 and insert the replacement refill tube in the bore. The user can then reinsert the refill assembly 36, including the replacement refill tube 48, into the distal opening 34 in the body. The user can then rotate the button 42 in the reverse direction of the arrow R to thread the refill holder 44 back into the first steel insert 46. As before, a stop or stops may be provided, though not shown herein, to automatically position the refill holder 44 and writing tip 26 relative to the body 30 for use. In one example that is useful for the removal technique of FIG. 8B, the proximal end of the button 42 may be configured to contact the distal end of the first steel insert 46 to position the writing tip 26 in the normal use position (which would inhibit or prevent the replacement technique of FIG. 8A).

The writing instrument assembly 20 in this example (see FIGS. 1-7) has a magnetic mechanism that utilizes magnetic attraction both to hold the pen 24 against the holder 22 and to automatically slide the tip cover end 60 of the sheath portion 58 over the writing tip 26. The second steel insert or steel sleeve 54 and the first steel insert 46 are provided on the pen 24 so as to interact with one or more magnets 70 that are provided on, in, or as a part of the holder 22 in order to simultaneously perform both functions. Thus, the steel sleeve 54 and steel insert 46 are formed of steel. These components can be made from other suitable materials, other than steel, and/or can be embedded with particles that have the desired magnetic properties.

In this example, the holder 22 has a pair of the magnets 70, as depicted in FIGS. 2 and 4-7, and an independent or discrete holder body 72 configured to receive and hold the pen 24. The body 74 of the holder 22 can take on virtually any shape, size, contour, and/or form while still functioning as intended. The magnets 70 in this example are received in recesses in the bottom of the holder body 72. In other examples, the magnets can be exposed to the pen 24 or can be embedded, in-molded, or otherwise disposed entirely within the material of the holder body 72. As needed, the magnets 70 can also be retained in position on the holder body 74 in any suitable manner, such as by using an adhesive material, mechanical retention features, or the like. The magnets 70 are configured and disposed to magnetically engage or interact with the steel insert 46 and steel sleeve 54 within the pen 24.

In this example, the holder 22 has a landing spot or contact surface 74 on one face of the holder body 72. The contact surface 74 can be contoured to match or compliment the exterior shape of the body 30 of the pen 24. In this example, the contact surface 74 is curved with a radius of curvature that can match that of the body 30 of the pen. When the pen 24 is attached to the contact surface 74 of the holder 22, the pen will nest in the holder body 72 against the contact surface 74.

Figure 6:
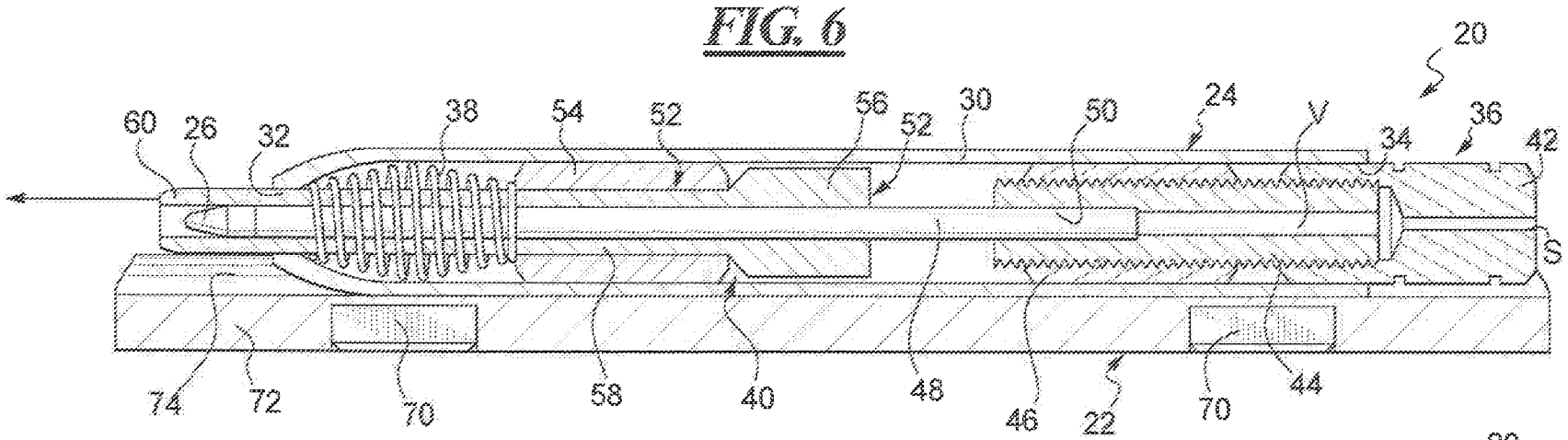
FIG. 6 shows a plan view of the cross-section of the writing instrument assembly of FIG. 2.

The magnets 70 are positioned at a certain distance apart from one another along the holder body 72. This distance can be greater than the distance between the steel sleeve 54 and steel insert 46 within the pen 24 (see FIGS. 6 and 7). To attach the pen 24 to the holder 22, the pen is positioned near the contact surface 74 of the holder 22 until the magnets 70 attract the pen to the holder. The pen 24 will then be drawn onto and held against the landing spot or contact surface 74 on the holder 22. When the pen 24 is attached to the holder 22, as shown in FIGS. 1, 2, and 6, the magnets 70 overcome the force of the compression spring 38 to draw the steel sleeve 54 in a direction away from the steel insert 46, which is in a fixed position, and toward the writing tip 26 of the pen 24 (see FIG. 6). This in turn draws the shroud 52 away from the refill holder 44 and extends the sheath portion 52 outward or further outward relative to the proximal opening 32. In doing so, this slides the tip cover end 60 of the sheath portion 58 over the writing tip 26. This occurs because, in this example, the magnets 70 on the holder 22 are spaced further part than the steel components, i.e., the steel insert 46 and steel sleeve 54 in the pen 24.

Figure 7:
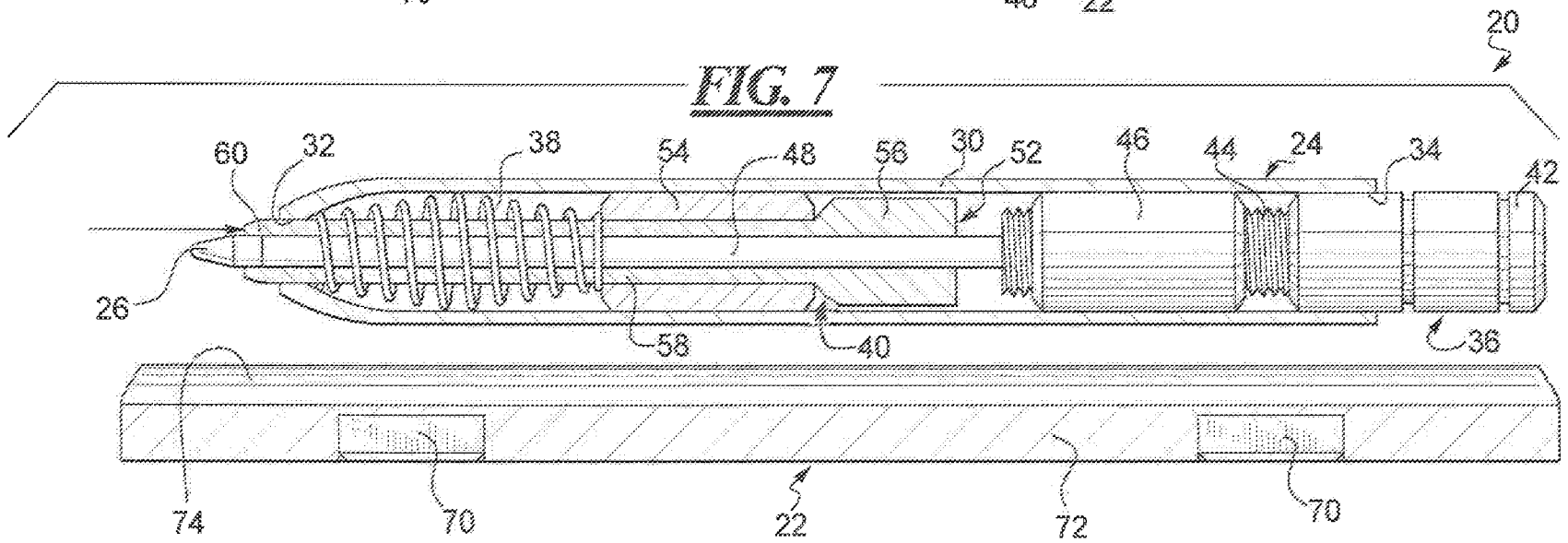
FIG. 7 shows a plan view of the cross-section of the writing instrument assembly of FIG. 4.

The pen 24 is detached from the holder 22 as depicted in FIGS. 3, 4, and 7 simply by pulling the pen 24 from the landing spot or contact surface 74 on the holder 22 with sufficient force to overcome the magnetic attractive force between the magnets 70 and the steel insert 46 and sleeve 54. The compression spring 38 will then expand, which retracts or withdraws the shroud 52 back into the proximal opening 32 in the pen body 30 and toward the refill holder 44. This slides the tip cover end 60 back into the proximal opening 32 in the pen body 30, exposing the writing tip 26 for writing. Thus, by the user removing the pen 24 from the holder 22 with one hand, the pen is automatically arranged in the open position and prepared for writing. No additional action is required of the user.

As noted above, the pen 24 and some of its components can be fabricated from copper or copper based materials or alloys to provide antimicrobial or antibacterial characteristics. The pen components can be formed of two or more different materials, depending on the material characteristics, function, aesthetic qualities, and the like that might be desired or required of each component. TABLE 1 below notes several optional copper based materials that utilize a majority of copper in the composition. However, other copper based materials and alloys may also certainly be used.

TABLE 1

Sample Copper and Copper Alloy Materials

| Alloy | EN Designation | Cu | Zn | Sn | Ni | P |
|---|---|---|---|---|---|---|
| Copper | CW004A | 99.9 | | | | |
| Phosphor Bronze | CW451K | 95 | | 4.8 | | 0.2 |
| Copper Nickel | CW352H | 90 | | | 10 | |
| 70/30 Brass | CW505L | 70 | 30 | | | |
| Nickel Silver | CW409J | 65 | 17 | | 18 | |

In the disclosed example, the shroud 52 can be formed of brass, which may be about 70% copper. The button 42 can be can also be formed of brass or can be formed of Nickel Silver or Copper Nickel to provide the desired antimicrobial or antibacterial characteristics and yet yield a different surface color to accent or enhance the look of the pen 24. The barrel or body 30 of the pen 24 can be formed of such alloys or can be formed primarily of pure Copper. The higher the Copper content, generally the better the antimicrobial or antibacterial effectiveness.

In addition, the pen 24 and its various components need not be made of copper or copper based materials, if desired and if the antimicrobial benefits of copper are not intended or desired. The barrel or body 30 can be made of other metals, such as aluminum, plastic, wood, or the like. The internal components of the pen 24, as well as the shroud 52 and button 42, can also be made of virtually any suitable material as well.

As will become evident to those having ordinary skill in the art, the writing instrument and holder of the writing instrument assembly can be varied from the above-described example in many ways while still functioning as intended and still falling within the spirit and scope of the disclosure. The refill tube removal mechanism can be varied. The button may be threaded and configured to move the refill body instead of being fixed to the refill body. The button may be a press button instead of being rotatable to achieve the same function as described above. The refill tube may be retained using some other retention device, other than friction. The shroud may take on different forms. The steel sleeve and/or steel insert may each also take on different forms, if desired. The magnets of the holder can be integrated into virtually any item or surface, if desired, to form a holder thereon. The number, size, shape, and positioning of the magnets can also vary.

More generally, the size, shape, contour, and configuration of the barrel or body 30 of the pen and holder can also vary from the example shown in FIGS. 1-8B and as described above. Likewise, the size, shape, contour, and configuration of the interior open space within the barrel or body and the internal components held therein can also vary within the spirit and scope of the disclosure. The shape and configuration of the pen components can be widely varied to alter the size, function, and/or aesthetic appearance of the pen.

Figure 9:
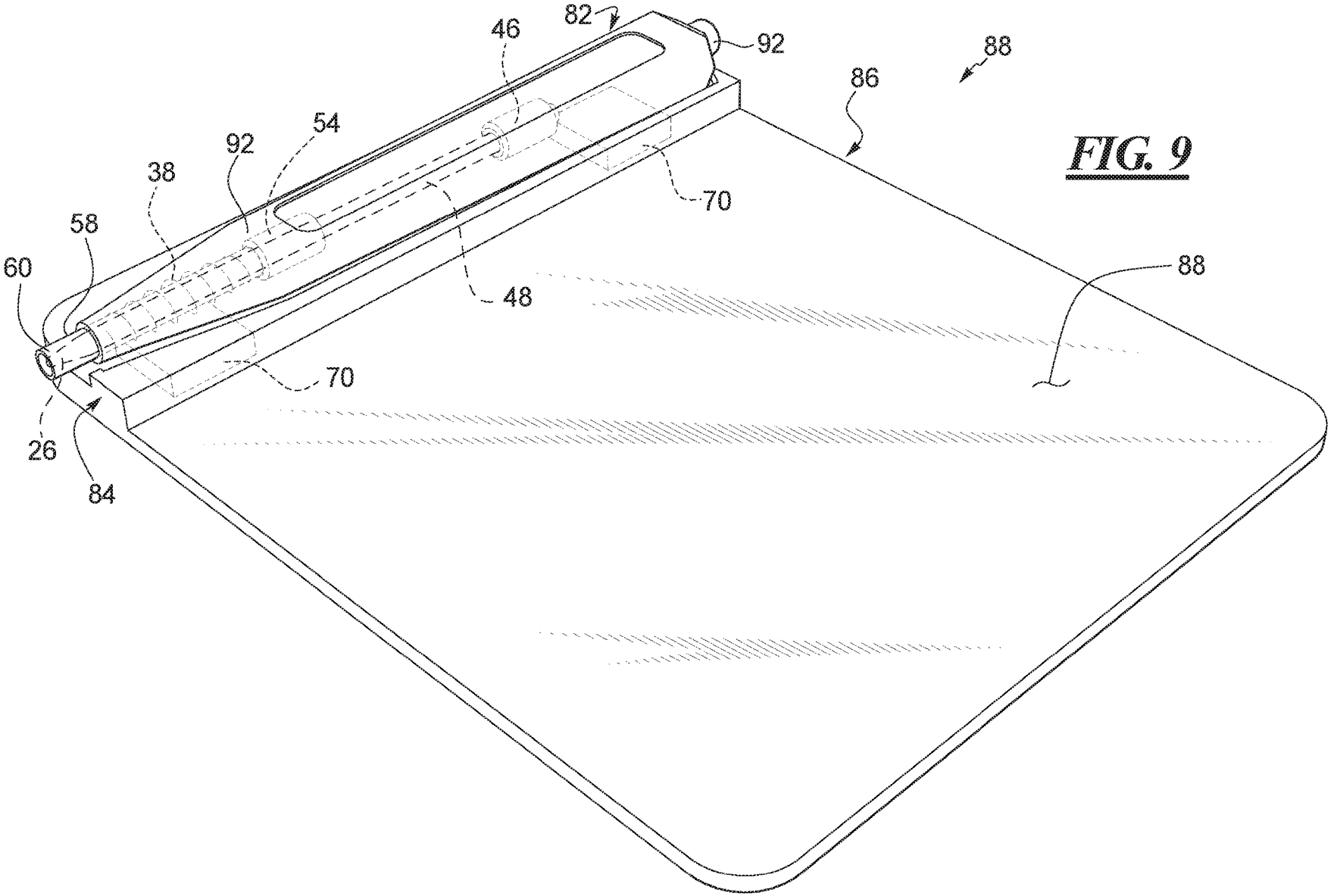
FIG. 9 shows a perspective view of another example of a writing instrument assembly constructed in accordance with the teachings of the present disclosure and including an alternative writing instrument and an alternative holder each having a different configuration.
Figure 10:
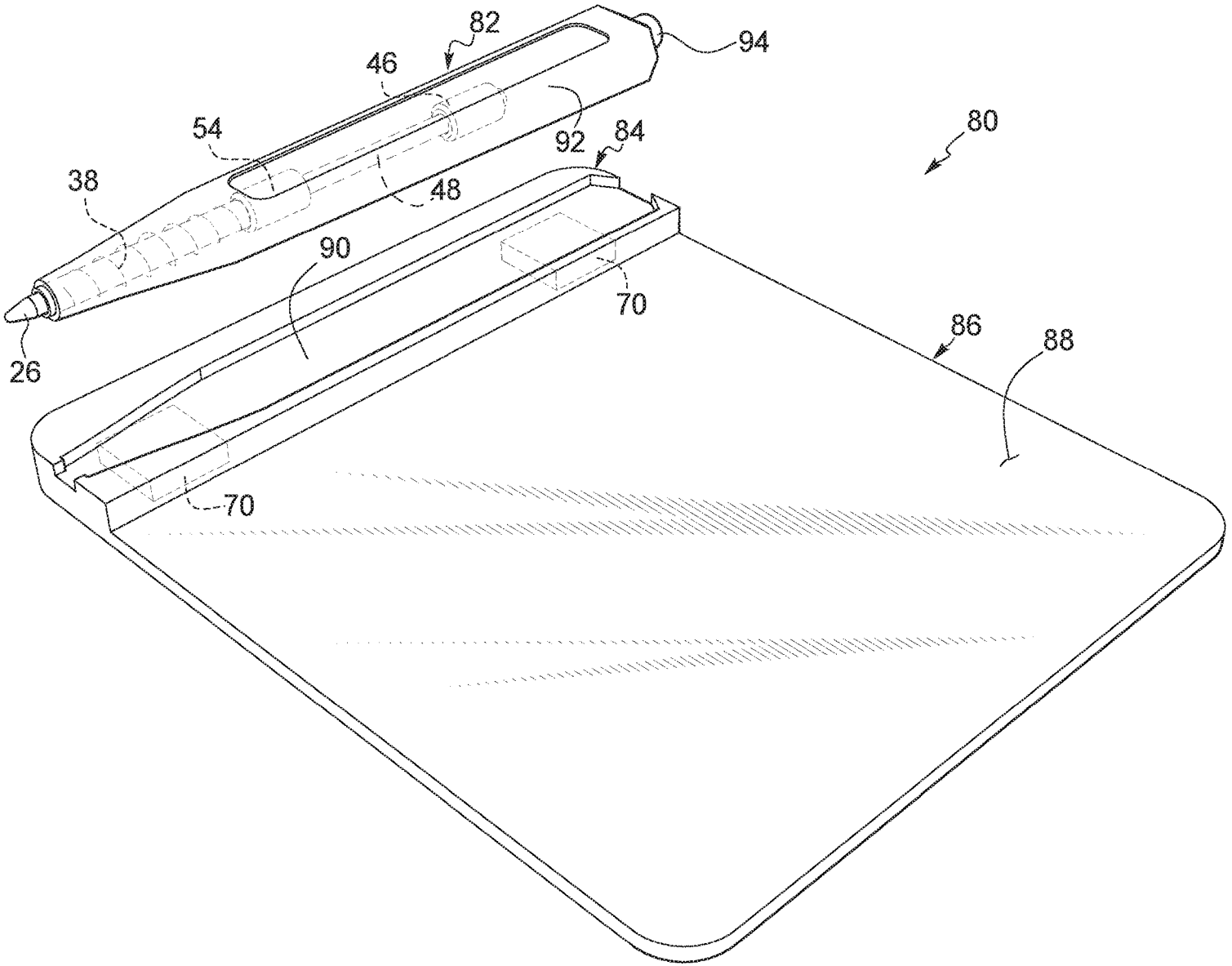
FIG. 10 shows the writing instrument assembly of FIG. 9 but with the writing instrument detached from the holder.

FIGS. 9 and 10 show one alternate example of a writing instrument assembly 80 constructed in accordance with the teachings of the present disclosure. In this example, the writing instrument assembly 80 has a pen 82 and a holder 84 that is integrated into or integrally formed as a part of another object 86. In this example, the object 86 can be any number of different objects. The object 86 has a main flat surface 88 that can be a writing surface of a clip-board like object, a display screen of an electronic tablet device, a surface for carrying identity indicia, or the like. Thus, the object can be a clip-board like writing device, an electronic tablet, a nametag, an identification (ID) card, an ID badge, or the like. The integrated holder 84 still includes magnets 70 and a landing spot or contact surface 90 that is recessed into the holder and is shaped to match that of the pen 82.

The writing instrument or pen 82 of the assembly 80 is also quite different in shape and configuration. In this example, the pen 82 has an irregularly sized hexagonal cross-section shaped barrel or body 92 with two larger flat sides. The flat sides of the pen 82 can be utilized to provide information such as marketing slogans, names, or other markings and the like on the pen itself, which may be useful to those of ordinary skill in the art. Such information can be etched, engraved, painted, adhered, or otherwise added to the pen body 92 as desired.

In this example, the pen 82 can still have a copper body 92, but with a differently shaped taper at the writing tip 26 or proximal end. The pen 82 also has a rotatable button 94 at the opposite distal end. Though not shown in detail herein, the pen 82 can also include the same or similar internal components with the body 92 so as to function in the same general manner as the earlier described pen 24. In this example, FIGS. 9 and 10 depict the spring 38, the steel sleeve 54, the refill tube 48, and the steel insert 46 internal to the pen 82.

Figure 12:
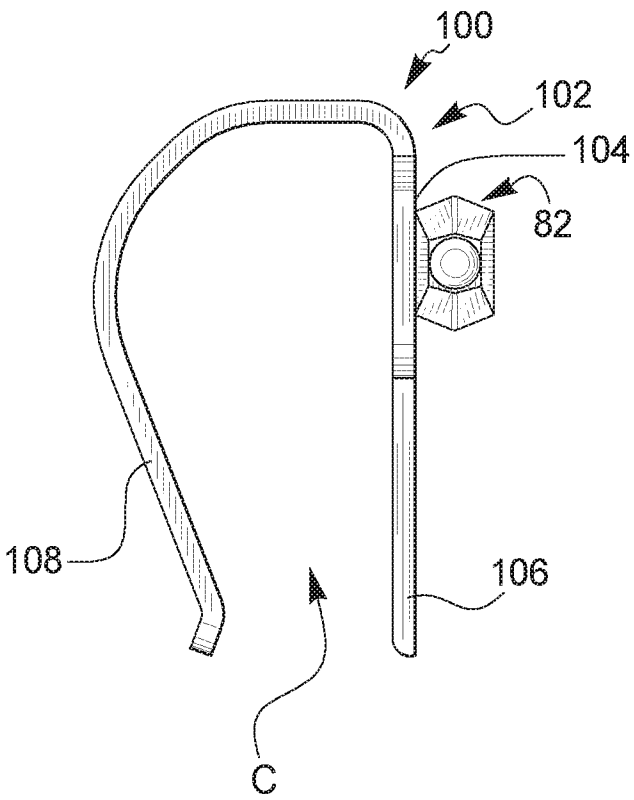
FIG. 12 shows a side view of the writing instrument assembly of FIG. 11.
Figure 11:
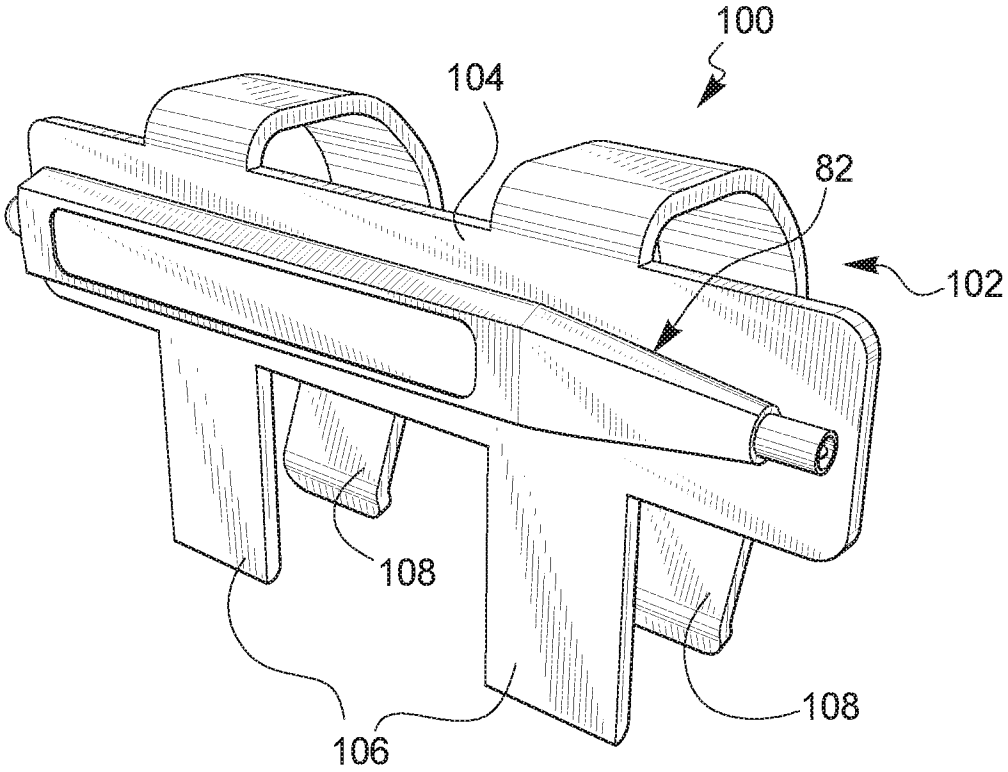
FIG. 11 shows a perspective view of another example of a writing instrument assembly constructed in accordance with the teachings of the present disclosure and including the writing instrument of FIGS. 9 and 10 and another alternative holder having a different configuration.
Figure 13:
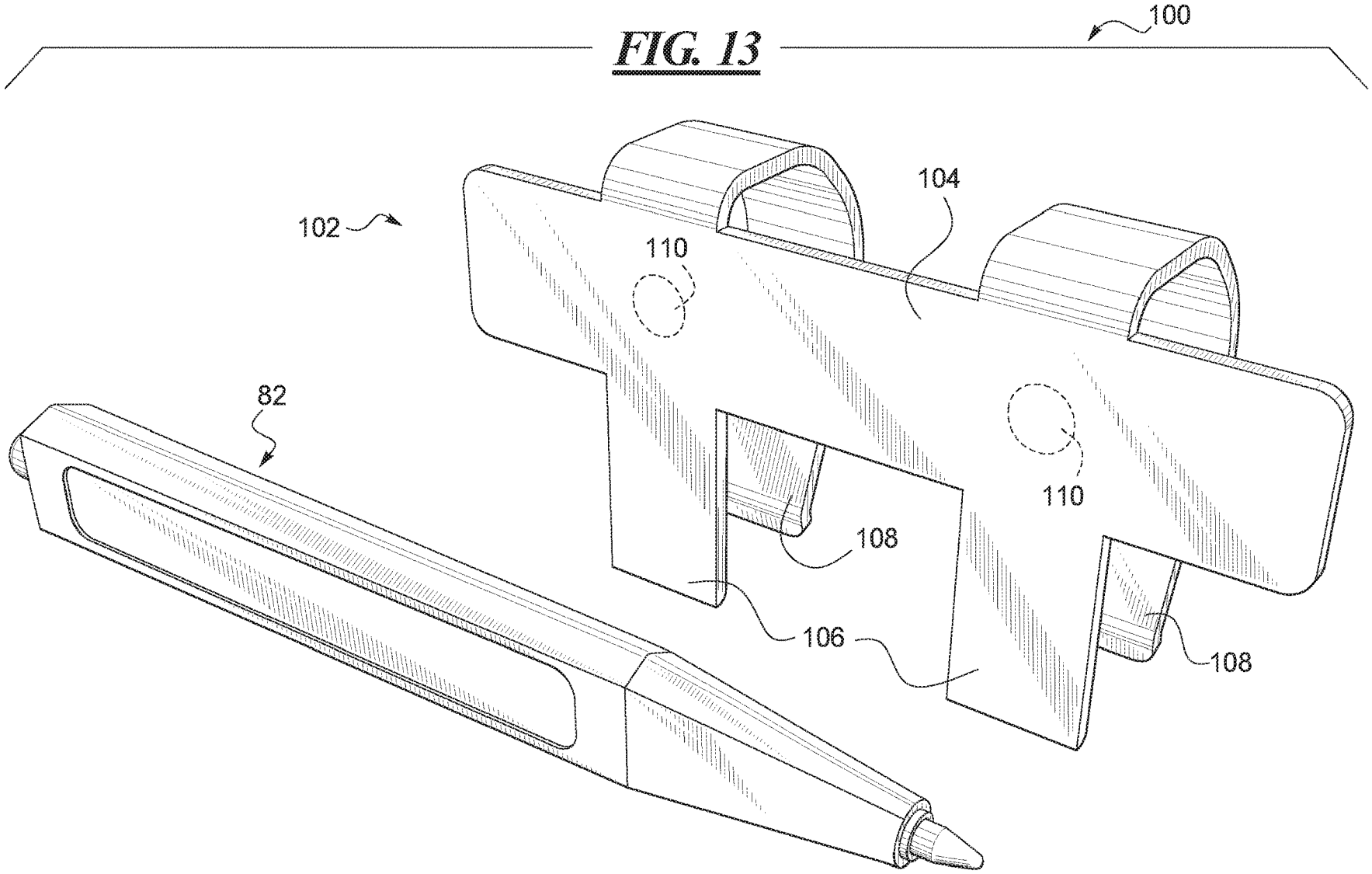
FIG. 13 shows the writing instrument assembly of FIG. 11 but with the writing instrument detached from the holder.

FIGS. 11-13 show another example of a writing instrument assembly 100 constructed in accordance with the teachings of the present disclosure. In this example, the same pen 82 of the prior example is utilized. However, the assembly 100 includes an entirely different holder configured for a specific purpose. The holder is a sun visor clip 102 for use in an automobile or other vehicle types. The visor clip 102 has a planar contact surface or plate 104 for attaching the pen 82. Two stabilizing legs 106 protrude from one edge of the plate 104. Two corresponding flexible and bent arms or fingers 108 protrude from the opposite edge of the plate 104. The flexible fingers 108 are each bent around to confront the back side of the plate 104, though the fingers are spaced apart from the plate, as depicted in FIGS. 11 and 12. A visor channel C is defined within the space between the plate 104 and the flexible fingers 108. As depicted in FIG. 13, two spaced apart magnets 110 or magnetic regions are formed on or carried on the plate 104 to attract and attach the pen 82 to the plate.

As will become evident to those having ordinary skill in the art, the visor clip 102 can also vary in configuration and construction. The clip can be formed with a different sized or shaped plate, a single stabilizing leg or more than two of such legs, a single flexible finger or more than two flexible fingers, an absence of stabilizer legs, and/or the like. Further, the visor clip can be made of any suitable type of metal or non-material, which provides adequate flexibility and resiliency.

Figure 15:
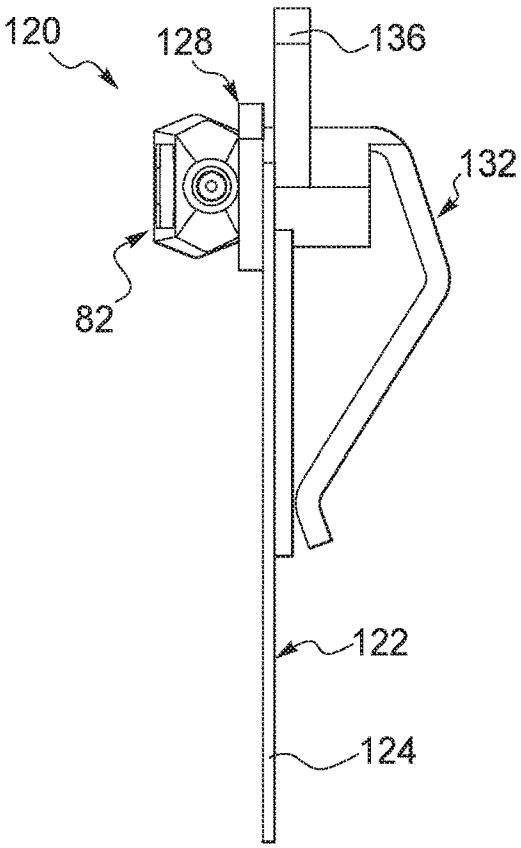
FIG. 15 shows a side view of the writing instrument assembly of FIG. 14.
Figure 14:
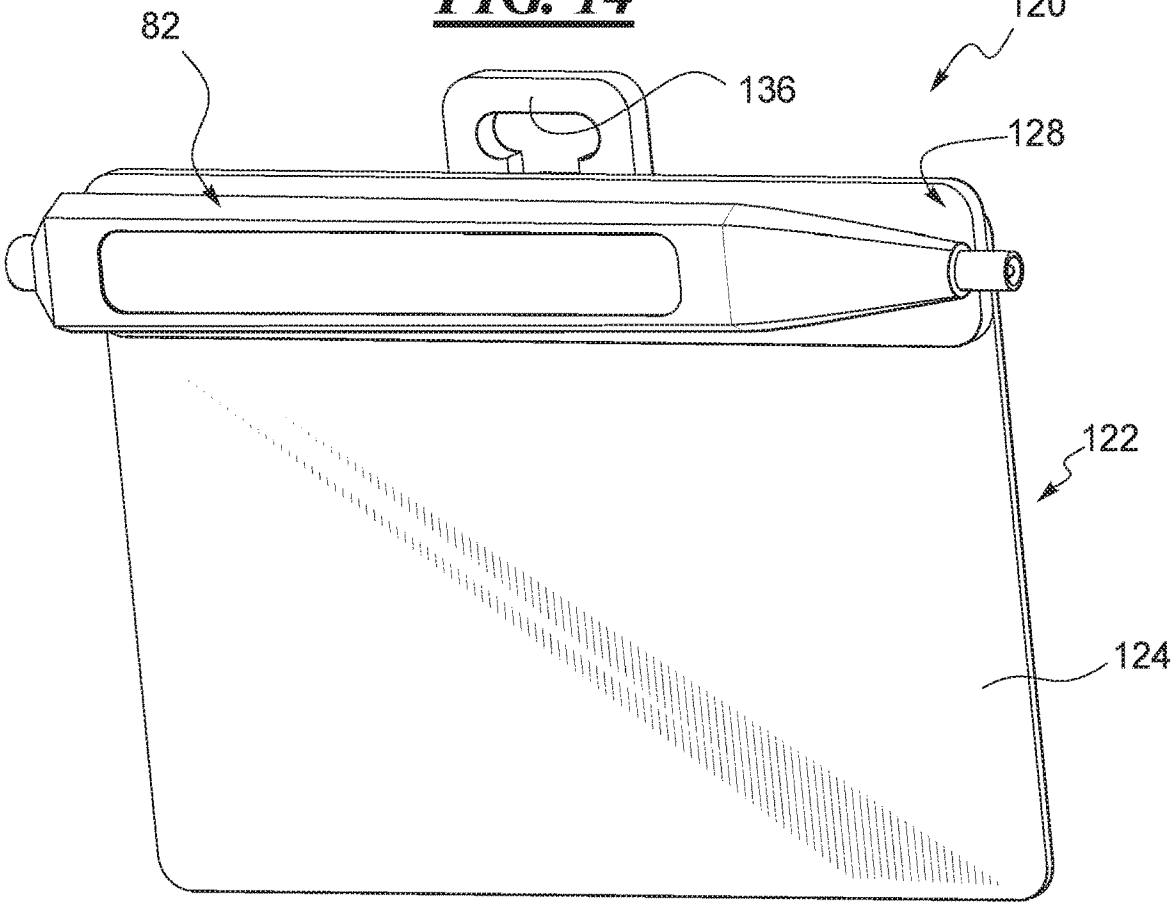
FIG. 14 shows a perspective view of another example of a writing instrument assembly constructed in accordance with the teachings of the present disclosure and including the writing instrument of FIGS. 9 and 10 and another alternative holder having a different configuration.
Figure 16:
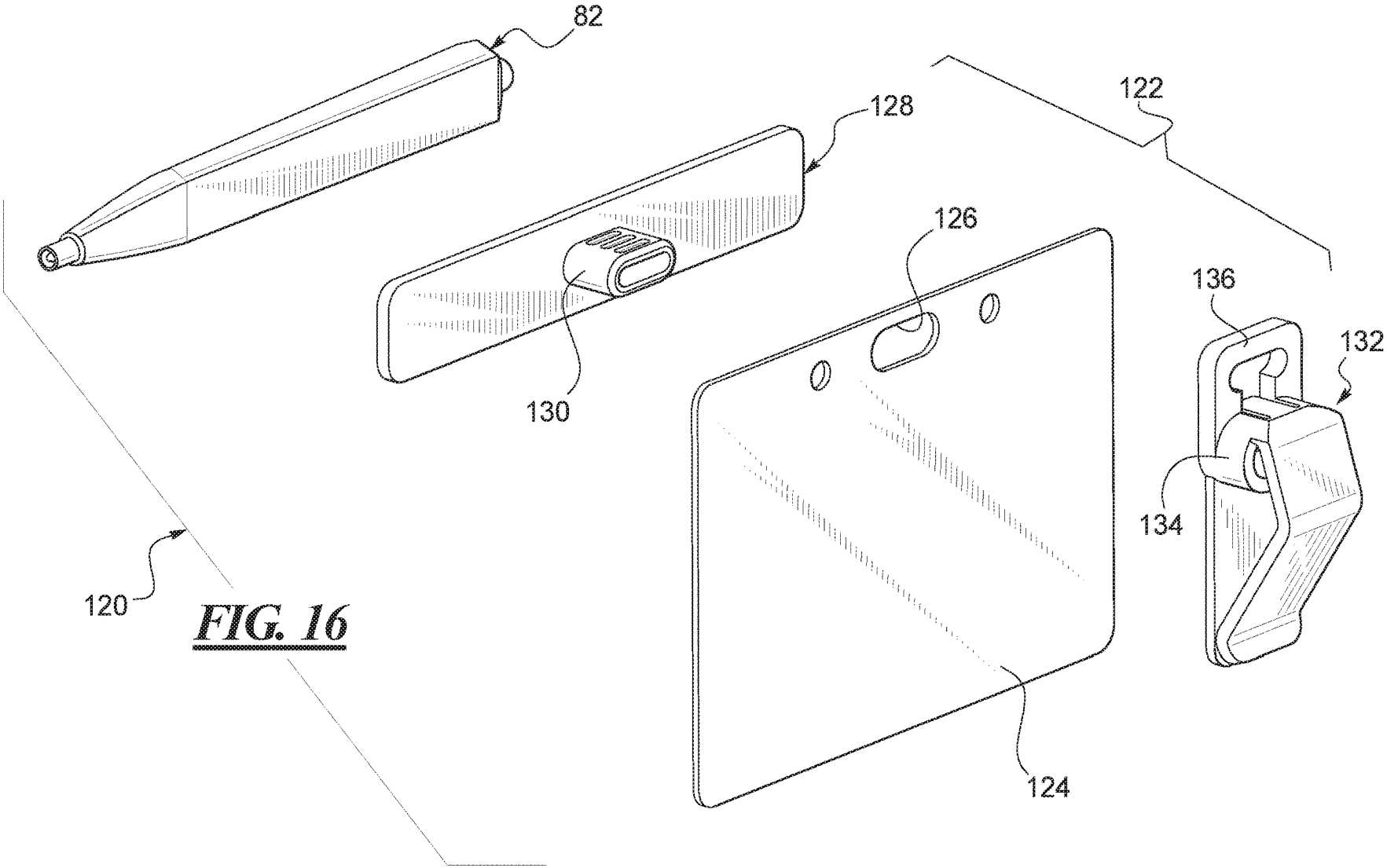
FIG. 16 shows the writing instrument assembly of FIG. 14 but with the writing instrument detached from the holder.

FIGS. 14-16 show yet another example of a writing instrument assembly 120 constructed in accordance with the teachings of the present disclosure. In this example, the same pen 82 of the prior two examples is again utilized. However, the assembly 120 again includes an entirely different holder arrangement that is configured for a specific purpose. The holder arrangement in this example is an ID badge assembly 122 with a planar badge placard 124. The placard 124 has a hole 126 near a top edge. A separate holder 128 has a flat front side defining the contact surface or landing spot for the pen 82. A boss 130 protrudes from the back side of the holder 128, which is sized to fit through the hole 126 in the placard 124. A badge clip 132 has a receiver 134 that is sized to accept the boss 130. The placard 124 is sandwiched between the holder 128 and the badge clip 132. The boss 130 can be fixed to the receiver in any number of suitable ways, such as by one or more fasteners, plastic or metallic welding, swaging, or the like. The badge clip 132 can be a spring clip of any known type so as to clip the writing instrument assembly 120 to a shirt or coat pocket or the like. This type of writing instrument assembly 120 may be especially well suited for a hospital or health care facility. The facility personnel may wear the ID badge at all times, which may keep the pen 82 readily available for use if attached to the holder 128. Also, the pen 82 can be formed of copper, as described above to provide the inherent antimicrobial properties. Though not shown in this example, the holder 128 can include two spaced apart magnets or magnetic regions on or available relative to the landing spot or contact surface of the holder.

As will become evident to those having ordinary skill in the art, the ID badge assembly 122 can also vary in configuration and construction. The badge clip, holder, and placard can each be formed with a different size or shape, can be assembled and/or attached to one another in different ways, and/or the like. Also, a lanyard attachment loop 136 can be provided as a part of the ID badge assembly 122 for attaching a lanyard to the assembly. In this example, the lanyard loop 136 is provided at the top of the badge clip 132, providing two alternate ways for a user to wear or attach the ID badge assembly 122. Instead, the lanyard loop can be provided directly on the placard 124 and the assembly can be provided without a separate badge clip. Also, the lanyard loop 136 may be eliminated from the assembly leaving on the badge clip for attachment. Further, the various parts of the ID badge assembly, including the badge clip, holder, and placard, can be made of any suitable type of metal or non-material, which provide the necessary or desired characteristics for each of the parts.

Figure 17:
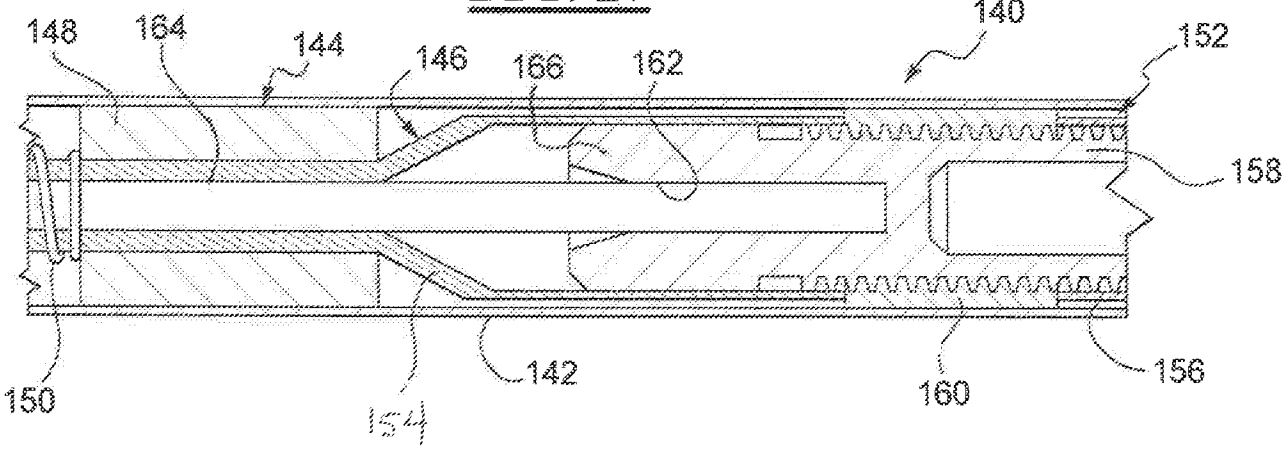
FIG. 17 shows a cross-section of a portion of another example of a writing instrument constructed in accordance with the teachings of the present disclosure.

As noted above, the internal components of the disclosed writing instruments or pens can also be modified and vary in configuration and construction while still performing as intended. FIG. 17 shows a portion of just one possible example of such a modified writing instrument or pen 140. In this example, the pen 140 is similar in construction to the pen 24. The pen 140 has a barrel or body 142, a sleeve assembly 144 with a shroud 146 and a steel sleeve 148 attached thereto, a compression spring 150, and a refill assembly 152, each arranged and constructed similarly to the pen 24 as earlier described, except as described below. In this example, the shroud 146 has a stop portion 154 that is a hollow cup shape. The refill assembly 152 has a button 156 on a distal end of a refill holder 158. A steel insert 160 is press fit into the body 142.

In this example, the refill holder 158 has a bore 162 and an ink refill tube 164 retained in the bore. However, the proximal end of the refill holder 158 includes an extended stop portion 166, which has a slightly larger diameter than the interior of the steel insert 160 and which is not threaded. The refill holder 158 is thus threaded into the steel insert 160, with the extended stop portion 166 protruding beyond and abutting the proximal end of the refill holder 158, prior to assembly of the pen 140. The button 156 is also then threaded onto the other end of the refill holder 158. As shown in FIG. 17, the hollow cup shaped stop portion 166 of the shroud 146 is sized to fit over and slide relative to the extended stop portion 166 as the shroud 146 moves within the body 142. The extended stop portion 166 acts as a travel stop, preventing retraction of the refill assembly 152 distally past the steel insert 160 from the distal end of the body 142. The button 156 can be rotated to extend the writing tip from the proximal end of the body, as described above with respect to FIG. 8B. The travel stop feature thus aids in properly positioning the writing tip relative to the body 142. The hollow stop portion 154 of the shroud 146 is designed and sized to fit around and slide over the extended stop portion 166, providing alignment and guide functionality. The hollow stop portion 154 and extended stop portion 166, or modified version thereof, can also allow for a more compact, i.e., shorter pen design, if desired.

The shroud 52 in the pen 24, on the other hand, has a solid stop portion 56 to guide the sleeve assembly 40 along the body 30. However, the stop portion 56 in that example does not slide over any portion of the refill holder 44. The steel sleeve 148 and steel insert 160 in the example of FIG. 17 may be the same as the earlier described sleeve 54 and insert 46 or may be of a different size and/or shape.

Figure 18:
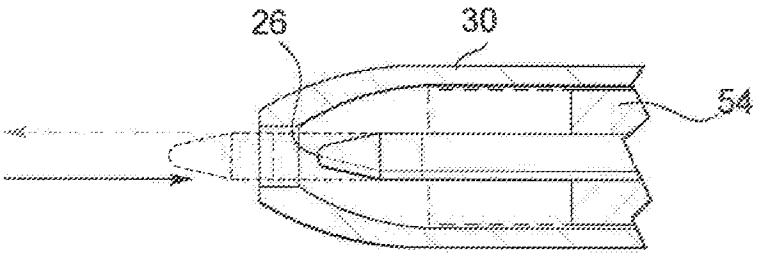
FIG. 18 shows another example of a portion of a writing instrument constructed in accordance with the teachings of the present disclosure.

In each of the disclosed examples, the tip cover end remains projecting slightly outward through the proximal opening in the body with the pen in the writing configuration. In other examples, the tip cover end may slide completely into the body when retracted. In still another example, as depicted in FIG. 18, the pen may not have a shroud at all. Instead, the writing tip 26 and ink refill tube 48 may instead be moved directly by the magnet mechanism to extend and expose the writing tip out of the body 30 and to retract the writing tip completely into the body, whereby the body covers the writing tip. In still another example, the shroud may be present but may instead remain stationary and the writing tip and ink refill tube may be designed to move or slide according to the magnetic forces applied or removed by the magnet mechanism. Further, the magnets may be provided on the writing instrument and the steel or otherwise magnetically attractive elements may be provided on the holder. Thus, the reverse construction of the attractive elements between the writing instrument and holder can be utilized, if desired. These and other variations are certainly possible.

The holder can be provided in any number of forms, as long as it is configured to hold and retain the pen when the pen is attached to the holder. In one example, the holder can be on, integrated with, or part of an ID badge carried by a user. In one example, the user can be a doctor, nurse, or staff member within a hospital. The user can instead be any person in need of a pen having one or more of the novel and advantageous features, aspects, or characteristics disclosed herein. In other examples, the user can be a worker within a clean manufacturing facility, a hardware store, a manufacturing plant, an office, or the like. The ID badge can be clipped onto the clothing of the user, can be carried on a lanyard suspended from a user, or carried on some other object such as a wall surface, a clip board, a table, a countertop, an electronic table, a hospital bed frame, or the like.

The writing instrument assembly concepts that are disclosed and described herein may be used to provide a simple, low-cost, one-handed operation, refillable pen. The writing instrument may optionally be fabricated from copper or one or more copper alloy for use by nurses and doctors in a healthcare environment. Instead, the writing instrument may be fabricated from other suitable materials where the benefits of using copper are not required or desired.

The writing instrument assemblies disclosed and described herein address the aforementioned problems and disadvantages with prior known writing instruments. The writing instrument is simply grasped and used. There is no cap that must be removed and no actuating mechanism that must be separately actuated. The writing instrument is just automatically ready to write or use when detached from its magnetic holder. When the writing instrument is replaced on the holder, the writing tip is automatically protected, and the pen is securely retained on the holder without a clip. In some of the disclosed examples, the writing tip is stationary and a separate shroud moves to cover or uncover the tip, making the pen simpler in design.

The disclosed pens or writing instruments provide a number of distinct advantages. First, the writing instrument body or barrel could be fabricated from copper or a copper-based alloy such as copper nickel, phosphor bronze, brass, or nickel-silver. This affords a level of protection against microbial contamination. Second, the pen has no separate clip, so the pen is easier and cheaper to make and assemble. Third, since there is no clip, the pen is easier to attach to and detach from a holder. Fourth, the pen has no user-actuated mechanism to extend or retract a writing tip or working tip. The pen operates automatically. Fifth, the pen has no cap to remove and potentially lose or misplace. The user simply grasps the pen and writes with it. All other 'traditional' interactions and intricacies are eliminated.

The 'clip' for the disclosed writing instrument assembly is a magnetic system or mechanism that retains the writing instrument or pen on a holder or nest. The holder can be conveniently and unobtrusively integrated into or attached to an ID badge as currently worn by all health care, and indeed many other, professionals today. The magnetic system not only retains the writing instrument on the holder automatically but also allows the writing tip to be 'capped' off, sheathed, or covered automatically during non-use. This can ensure no risk of ink transfer to surfaces other than those that one might wish to write on. The simple action of removing the writing instrument from the holder for use automatically 'removes' the 'cap' or sheath and exposes the writing tip or working tip ready for writing action or use. There is no need to use a push-button to protract the writing tip because it is already and automatically ready to use. Further, when done with writing or use, the user need only approach the holder or nest with the writing instrument or pen and it is automatically 'snatched' from the user, simultaneously retaining the pen, capping it, and retracting or covering the tip.

In the disclosed examples, the pen itself may be designed and sized to fit most ID badge dimensions. As such, the pen may lend itself well to health care environments, schools, corporate offices, police stations, and the like, where badge access is required and readily-available pens are a benefit. However, even outside of these areas, there are opportunities for such a writing instrument assembly or system, such as in cars, taxis, and private vehicles, where often times it may be difficult to find a pen. The disclosed pen holder or nest can be designed such that it clips onto to a sun visor in a car or onto other object in a different environment for ease of access and with one-handed operation. Similarly, the disclosed pen may be of value in other environments such as banks, gyms, construction sites, and the like where a 'tethered' pen could be of value, or a copper-based pen could afford microbial protection between uses of a shared writing instrument.

Figure 19:
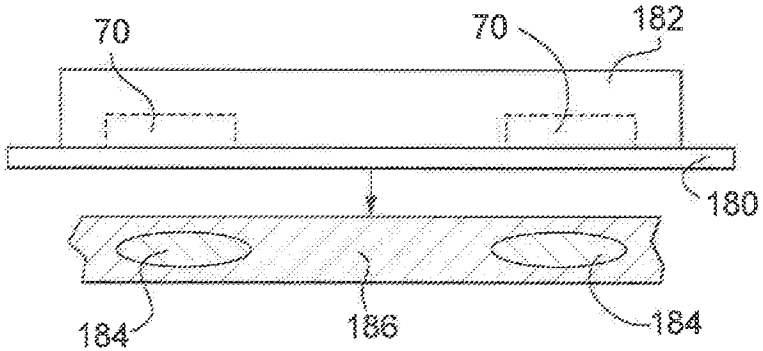
FIG. 19 shows another example of a holder arrangement for the writing instrument assemblies constructed in accordance with the teachings of the present disclosure.

The holder may be attached to or within or integrated into handbags, purses, and other personal carriers. For example, within some women's purses, it can often be difficult to locate a pen that is known to be there. The disclosed holder could be utilized for holding the pen in place in the purse and could protect other items from ink stains. In one example, as depicted in FIG. 19, a steel backing plate 180 can be provided on a holder 182, opposite the landing spot for the writing instrument or pen. In such an example, one or more magnets 184 can be carried on another surface or object 186 and the holder 182 can be removably attached to the other surface or object. The strength of these additional magnets 184 can be stronger than the magnets 70 attaching the pen to the holder 182 so that detaching the pen does not detach the holder from the other surface or object 186.

The pen designs disclosed herein also include the environmental benefit of being relatively easily refillable. By twisting the end button (the only time the end button is used), the refill tube may be withdrawn and removed (see for example, FIGS. 8A and 8B and the accompanying description) and then replaced with a new one. The refill tube can be virtually any size or shape, but can be a standard and readily-available D1 refill or the like. The refill tube can be protracted from the pen body, pulled from the pen, and replaced with a fresh refill. The end button is easily rotated in one direction to protract the refill tube or to remove the refill assembly for replacement of the refill tube, and then in the other direction to retract the new refill tube or to reinstall the refill assembly to be ready for use.

As noted above, variants of the disclosed pens or writing instruments are anticipated, many of which can be at as low a cost as possible given the materials of construction. In one example, the disclosed pens can be fabricated from copper or copper-based alloys. In another example, the pens can be a plastic molded variant without the attendant microbial protection, but with the inherent functional convenience. Other materials are also certainly possible. In a further example, the magnetic mechanism can move the refill tube, and thus the writing tip or working tip of the instrument into and out of the body, instead of a sleeve or sheath covering the tip. In yet another example, the magnetic mechanism may be configured to move both a cover or sheath as well as the writing tip or working tip. The magnetic mechanism can be designed to also keep the writing tip or working tip in the exposed position without any additional locking or latching mechanism when detached from the holder.

The disclosed assemblies, pens, and holders are described having a particular combination of features, components, characteristics, and aspects. The disclosed invention is not limited to only the disclosed combinations. Each feature, component, characteristic, and aspect of the disclosed invention may be used alone or in combination with any one or more of the other features, components, characteristics, and aspects. The disclosure is intended to cover all such other combinations.

Although certain writing instrument assemblies, writing instruments, holder arrangements, and holders, have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A writing instrument assembly comprising:

a writing instrument having a body and a working tip extended from the body and a sheath slidably positioned in the body; and a holder providing a landing spot for the writing instrument, wherein the writing instrument is magnetically and detachably retained at the landing spot when attached to the holder, wherein the working tip is covered by the sheath automatically when the writing instrument is retained at the landing spot, and wherein the working tip is exposed from the sheath automatically when the writing instrument is separated from the landing spot.

2. A writing instrument assembly according to claim 1, wherein the holder includes one or more magnets.

3. A writing instrument assembly according to claim 2, wherein the writing instrument includes one or more magnetically attractive elements positioned to engage or interact with the one or more magnets.

4. A writing instrument assembly according to claim 3, wherein the magnetically attractive elements are steel bodies within the body of the writing instrument.

5. A writing instrument assembly according to claim 4, wherein the steel bodies are ring or cylinder shaped.

6. A writing instrument assembly according to claim 1, wherein the holder further comprises a steel backing plate rendering the holder magnetically attachable to another surface or object.

7. A writing instrument assembly according to claim 1, wherein the holder is part of an ID badge.

8. A writing instrument assembly according to claim 1, wherein the holder is formed as an integral monolithic part of another object.

9. A writing instrument assembly according to claim 1, wherein the holder is a separate part that is attached to or attachable to another object.

10. A writing instrument according to claim 1, wherein the body is formed of a copper or a copper-based alloy.

11. A writing instrument assembly according to claim 1, wherein one or more magnets are provided on the holder or on the writing instrument, and wherein one or more attractive elements are provided on the other of the holder or the writing instruments, the one or more attractive elements positioned to magnetically engage or interact with the one or more magnets when the writing instrument is attached to the holder.

12. A writing instrument assembly according to claim 1, wherein the working tip always protrudes from the body and the sheath moves relative to the working tip.

13. A writing instrument assembly according to claim 1, wherein the body is formed of copper or a copper-based alloy material and the sheath is formed of copper or a copper-based alloy material that is different from the copper or copper-based alloy material of the body.

14. A writing instrument according to claim 1, wherein the mechanism includes a spring configured to bias the sheath to a position not covering the working tip.

* * * * *